US005678286A

United States Patent [19]

Murasaki

[11] Patent Number: 5,678,286

[45] Date of Patent: Oct. 21, 1997

[54] SHEET FASTENER FOR SHEET-LIKE ARTICLE

[75] Inventor: Ryuichi Murasaki, Toyama, Japan

[73] Assignee: YKK Corporation, Japan

[21] Appl. No.: 678,480

[22] Filed: Jul. 9, 1996

[30] Foreign Application Priority Data

Jul. 10, 1995 [JP] Japan ..... 7-173597

[51] Int. Cl.[6] ..... A44B 18/00

[52] U.S. Cl. ..... 24/444

[58] Field of Search ..... 428/100; 24/442, 24/444, 452

[56] References Cited

U.S. PATENT DOCUMENTS

| | | | |
|---|---|---|---|
| 3,391,434 | 7/1968 | Girard | 24/444 |
| 3,777,435 | 12/1973 | Perina | 428/100 X |
| 4,353,142 | 10/1982 | Nishiyama et al. | 24/442 X |
| 5,026,588 | 6/1991 | Diekmann | 428/100 |
| 5,067,210 | 11/1991 | Kayaki | 24/452 |

FOREIGN PATENT DOCUMENTS

| | | |
|---|---|---|
| 0 464 753 | 1/1992 | European Pat. Off. . |
| 0 499 461 | 8/1992 | European Pat. Off. . |
| 6-007208 | 1/1994 | Japan . |

*Primary Examiner*—James R. Brittain

*Attorney, Agent, or Firm*—Hill, Steadman & Simpson

[57] ABSTRACT

A sheet fastener for fastening a sheet-like article to an attachment having along opposite side edges a pair of generally C-cross-section fitting gutters with confronting openings. The fastener comprises a plate-like substrate having opposite side margins adapted to be fitted in the respective fitting gutters, and a multiplicity of surface-fastener male engaging elements projecting integrally from one surface of the plate-like substrate at its central region extending between the side margins. The plate-like substrate has a thickness substantially equal to the width of each of the fitting gutters, and each side margin has a number of discrete recesses longitudinally spaced at distances.

18 Claims, 4 Drawing Sheets

SHEET FASTENER FOR SHEET-LIKE ARTICLE

BACKGROUND OF INVENTION

1. Field of the Invention

This invention relates to a fastener for fastening a sheet-like article to an attachment, and more particularly to a fastener strip having a multiplicity of surface-fastener male engaging elements of synthetic resin for hanging a curtain, a projection screen, a blackout curtain, an advertisement drop curtain, etc. on a hanger or for fastening an interior member, such as wall paper or a carpet, to a panel.

2. Description of the Related Art

Attempts have been made to attach a curtain to a generally C-cross-section curtain rail. To this end, a concept has been proposed in which a fastener strip having a multiplicity of male engaging elements projecting integrally from one surface of a plate-like substrate is fitted in and along the curtain rail and, on the other hand, a fastener strip having a multiplicity of female engaging elements is attached to an upper edge of the curtain for engagement with the male fastener strip to thereby fasten the curtain to the curtain rail. As disclosed in, for example, Japanese Utility Model Laid-Open Publication No. Hei 5-70313, this fastener is usable not only for fastening a curtain but also for attaching an interior member, such as wall paper and a carpet, to a panel.

In the sheet fastener disclosed in Japanese Utility Model Laid-Open Publication No. Hei 5-70313, the plate-like substrate has on one surface a row of discrete ridges along each of opposite side margins so that the sheet fastener is firmly attached to the curtain rail as each discrete ridge row is pressed against the inner wall surface of each of opposite fitting gutters of the curtain rail.

According to this prior art sheet fastener, because of the ridge row, it is pressed against the inner wall surfaces of the gutters of the attachment to realize firm fastening. However, since the height of the engaging-element-side surface of the plate-like substrate is smaller than the width of the fitting gutters of the attachment by the height of the ridge rows, the extent to which the engaging elements project above the upper surface of the attachment is limited so that the stems of the individual engaging elements must be increased in height in order to secure an adequate rate of engagement. This means, with their size unchanged, the stems would be too flexible so that an ideal degree of engaging strength is difficult to achieve.

SUMMARY OF THE INVENTION

It is therefore an object of this invention to provide a sheet fastener which guarantees both an adequate rate of engagement and an adequate degree of engaging strength and can be secured to an attachment firmly.

According to a first aspect of the invention, the above object is accomplished by a sheet fastener for fastening a sheet-like article to an attachment having along opposite side edges a pair of generally C-cross-section fitting gutters with confronting openings, the fastener comprising: a plate-like substrate having opposite side margins adapted to be fitted in the respective fitting gutters, the plate-like substrate having a thickness substantially equal to the width of each of the fitting gutters, the side margins having a number of discrete recesses longitudinally spaced at distances; and a multiplicity of surface-fastener male engaging elements projecting integrally from one surface of the plate-like substrate at its central region extending between the side margins.

Preferably, the plate-like substrate has continuous or discrete grooves in longitudinal or transverse rows between the male engaging elements, and the side margins have in part a wedge-shape cross section gradually decreasing in thickness toward the edge.

Preferably, the plate-like substrate including the side margins is curved along its entire width with the engaging-element-side surface concave.

According to a second aspect of the invention, the above object is accomplished by a sheet fastener for fastening a sheet-like article to an attachment having along opposite side edges a pair of mutually formed fitting gutters each extending transversely from a lower portion of each of opposite side edges of a flat central portion via a stepped portion to define a fitting hollow having a generally rectangular cross section, the fastener comprising: a plate-like substrate having opposite side margins to be substantially intimately fitted in the respective fitting hollows of the fitting gutters of the attachment; and a multiplicity of surface-fastener male engaging elements projecting integrally from one surface of the plate-like substrate at its central region extending between the side margins.

In the most preferred embodiment according to the first-named invention, the attachment is a curtain rail having an L-shape attaching arm integrally projecting from each of opposite edges so as to define an inwardly opening, generally C-cross-section fitting gutter, which is substantially identical in construction with that of the conventional attachment.

On the other hand, the sheet fastener is substantially identical in length with the attachment and has a width substantially equal to the distance between the bottom surfaces of the confronting gutters of the attachment, there being a multiplicity of hook-shape engaging elements projecting from one surface of the plate-like substrate through the entire region except the side margins. These engaging elements are identical in shape with those of an ordinary molded surface fastener and, alternatively, they may be mushroom-shaped engaging elements or male engaging elements each having a compound-leaf curved portion.

In the first-named invention, the thickness of the plate-like substrate is substantially equal to the width of the fitting gutters of the attachment, and each of the side margins has on its engaging-element-side surface a row of discrete recesses along the length. If the side margins had only flat surfaces, they would have tended to become wavy or puckered longitudinally after molding and could not have been fitted smoothly into the respective fitting gutters of the attachment. In the illustrated embodiment, each side margin has on one side a continuous uneven surface though its entire length so as to be free from becoming puckered. Further, partly since the plate-like substrate and the side margins have the same thickness, and partly since this thickness is a rational thickness substantially equal to the width of the fitting gutters of the attachment, it is possible to minimize the difference in height between the upper surface of the plate-like substrate and the upper surface of the fitting gutters of the attachment so that it is unnecessary to increase the height of the stems of the male engaging elements. This means, the curved portions of the male engaging elements which project from the plate-like substrate can project above the fitting gutters of the attachment to an adequate extent so that the male engaging elements can firmly be engaged with the female engaging elements of the companion fastener member, thus guaranteeing a required degree of engaging strength.

Further, the plate-like substrate has on one surface a plurality of longitudinal grooves between each pair of adjacent longitudinal rows of male engaging elements. The grooves serve to give an appropriate degree of deformability to the plate-like substrate if the substrate itself is rigid, and also serve to correct the curved form created transversely of the substrate during molding. As long as it is possible to give an appropriate degree of deformability to the substrate, the plate-like substrate may alternatively have on one surface a plurality of transverse grooves between each pair of adjacent longitudinal rows of male engaging elements.

As the male-engaging surface of hook-shape engaging elements of the fastener is pressed against the companion female-engaging surface of loop-shape engaging elements of a surface fastener member attached to the rear surface of a sheet-like article, such as a curtain, at its upper end by suitable securing means such as sewing or adhering, the hook-shape engaging elements and the loop-shape engaging elements come into mutual engagement.

In the second-named invention, the side margins of the sheet fastener are set in a level lower than the upper surface of the plate-like substrate, and the attachment has between a plate-like attaching portion and side fitting gutters a stepped portion having a height substantially equal to the thickness of the plate-like substrate of the sheet fastener, the fitting gutters having such an interior shape that the side margins of the sheet fastener can be intimately fitted in the respective fitting gutters, thus attaching the sheet fastener to the attachment firmly. Further, since the upper surface of the substrate of the sheet fastener is higher than the upper surface of the fitting gutters of the attachment by a larger extent as compared to the case where the upper surface of the substrate is substantially even in level with the upper surfaces of the fitting gutters, the curved portions of the hook-shape engaging elements of the plate-like substrate project above at least the upper surfaces of the attachment so that the male engaging elements can be engaged with the companion female engaging elements certainly, thus securing an adequate degree of engaging strength.

DETAILED DESCRIPTION OF THE PREFERRED EMBODIMENTS

Figure 1:
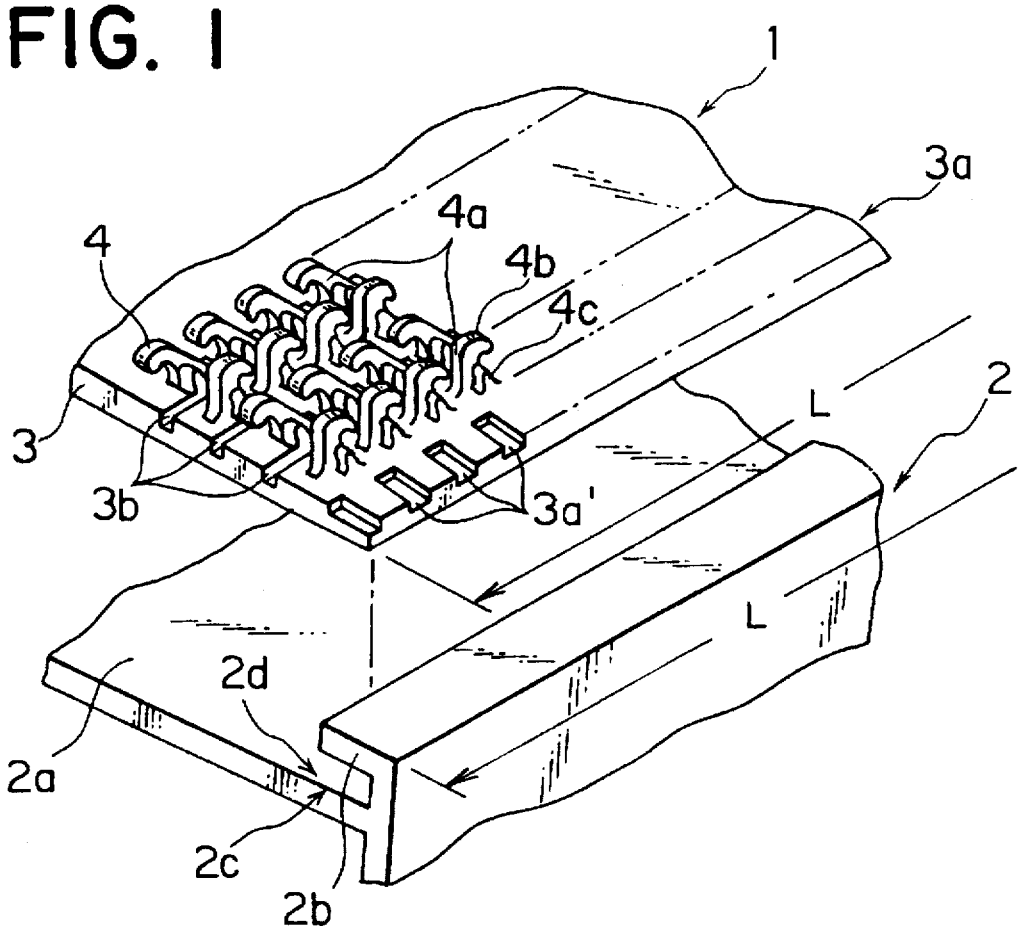
FIG. 1 is a fragmentary, exploded perspective view showing a sheet fastener, together with an attachment, according to a first embodiment of this invention.
Figure 2:
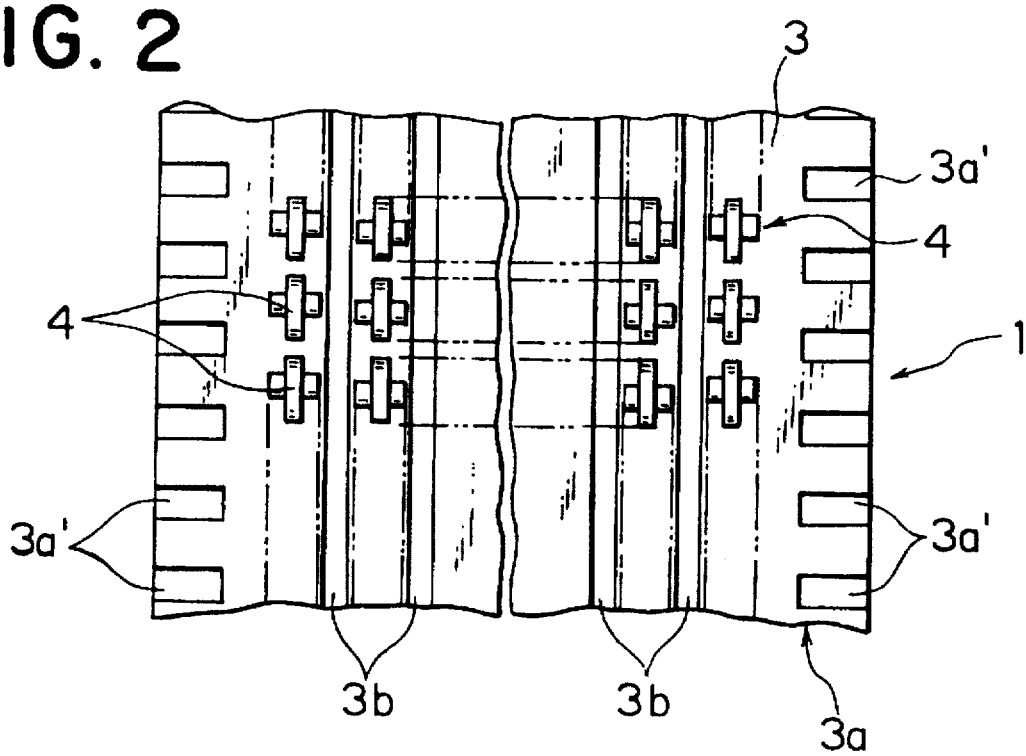
FIG. 2 is a fragmentary top plan view of the sheet fastener of the first embodiment.
Figure 3:
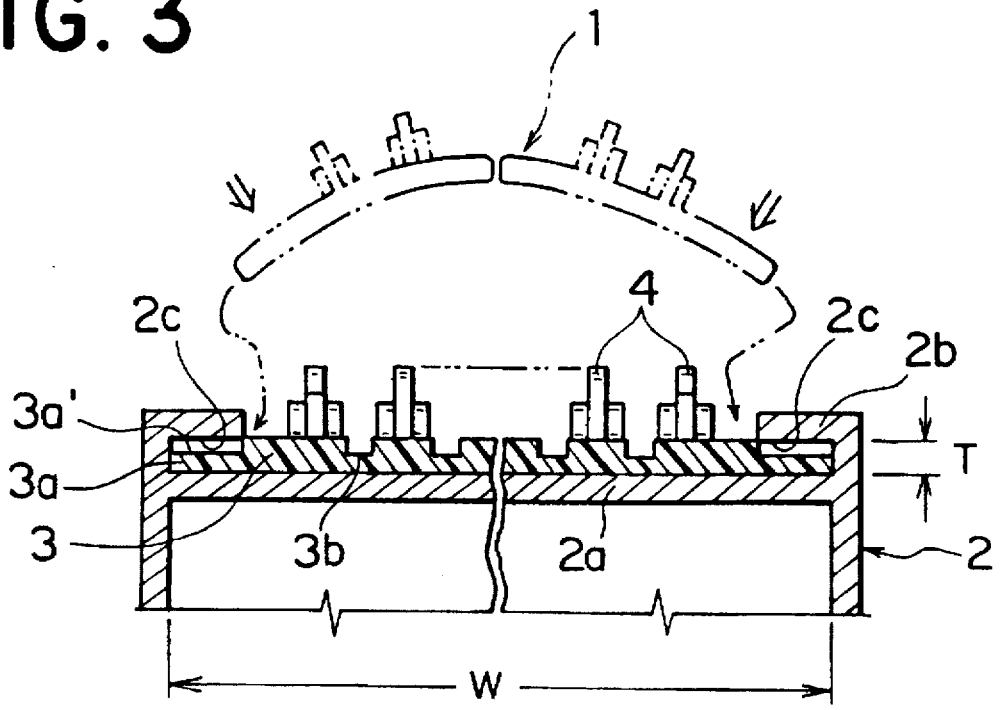
FIG. 3 is a cross-sectional view showing the manner in which the sheet fastener is attached to the attachment.

Preferred embodiments of this invention will now be described in detail with reference to the accompanying drawings. FIG. 1 is a fragmentary, exploded perspective view showing a sheet fastener, together with an attachment, according to a first embodiment of this invention. FIG. 2 is a fragmentary top plan view of the sheet fastener of the first embodiment. FIG. 3 is a transverse cross-sectional view showing the manner in which the sheet fastener of the first embodiment is attached to the attachment.

In FIGS. 1 through 3, reference numeral 1 designates a sheet fastener for a sheet-like article of the first embodiment, and reference numeral 2 designates an attachment to which the sheet fastener 1 is to be attached. In this embodiment, the attachment 2 is a curtain rail on which a non-illustrated curtain is hung. The attachment 2 has an L-shape attaching arm **2*b* integrally extending along each of opposite side edges of a plate-like attaching portion 2*a* so as to form an inwardly opening, generally C-cross-section fitting gutter 2*c*** in which each of opposite side margins (described below) is to be fitted. This attachment is substantially identical in construction with the conventional attachment.

On the other hand, the sheet fastener 1 has a plate-like substrate 3 having a length L substantially equal to the length of the attachment 2, a width W substantially equal to the distance between the bottom surfaces of the confronting fitting gutters **2*c* of the attachment 2 as shown in FIGS. 1 and 3, and a thickness T substantially equal to the width of the fitting gutters 2*c*. The sheet fastener 1 has a multiplicity of hook-shape engaging elements 4 integrally projecting from one surface of the plate-like substrate 3 at its central region extending between opposite side margins 3*a*. The individual hook-shape engaging element 4 has a stem 4*a* standing from the substrate 3, and a curved portion 4*b* extending from the stem 4*a* longitudinally of the substrate 3 and terminating in a tip directed toward the substrate 3. The individual hook-shape engaging element 4 additionally has a reinforcing rib 4*c* integrally formed on the side surface of the stem 4*a* and having a desired height. The engaging elements 4** should by no means be limited to the illustrated example and may be mushroom-shape engaging elements or male engaging elements each having a multi-leaf curved portion.

In this invention, the thickness T of the plate-like substrate 3 is substantially equal to the width of the fitting gutters **2*c* of the attachment 2, and the shape of the side margins 3*a* constitutes an important part of the invention. Specifically, each side margin 3*a* has on its engaging-element-side surface a longitudinal row of discrete recesses 3*a*'**, thus making the engaging-element-side surface continuously uneven through its entire length.

Figure 4:
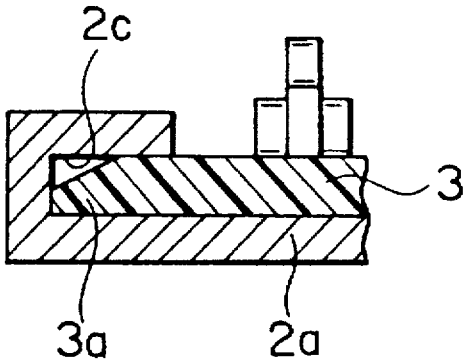
FIG. 4 is a detailed cross-sectional view showing a modification of the sheet fastener of the first embodiment.

Generally, in continuously molding the above-mentioned band-like fastener, if the side margins had simply smooth surfaces, the side margins would have become puckered longitudinally so that they would have been very difficult to enter the fitting gutters **2*c* of the attachment 2 sideways during attaching as shown in FIG. 3. Consequently, in this embodiment, the side margins 3*a* are provided with these longitudinal continuous uneven surfaces to eliminate the puckering. FIG. 4 shows a modification of the side margin 3*a*, according to which the side margin 3*a* has a wedge-shape cross section to facilitate inserting into the fitting gutter 2*c* of the attachment 2** sideways.

With the rows of discrete recesses **3*a*' along the respective side margins 3*a*, since it is possible to set the thickness of plate-like substrate 3 equal to that of the side margins 3*a* and also to set this thickness to a rational thickness substantially equal to the width of the fitting gutters 2*c* of the attachment 2, the upper surface of the plate-like substrate 3 can be approximated to the height of the fitting gutters 2*c*** of the attachment 2. This means, the curved portions 4*b* of the individual male engaging elements 4 project above the fitting gutters 2*c* by an adequate extent, without unnecessarily increasing the height of the stems 4*a*, so that they can engage with the companion female engaging elements certainly with an adequate degree of engaging strength.

Figure 5:
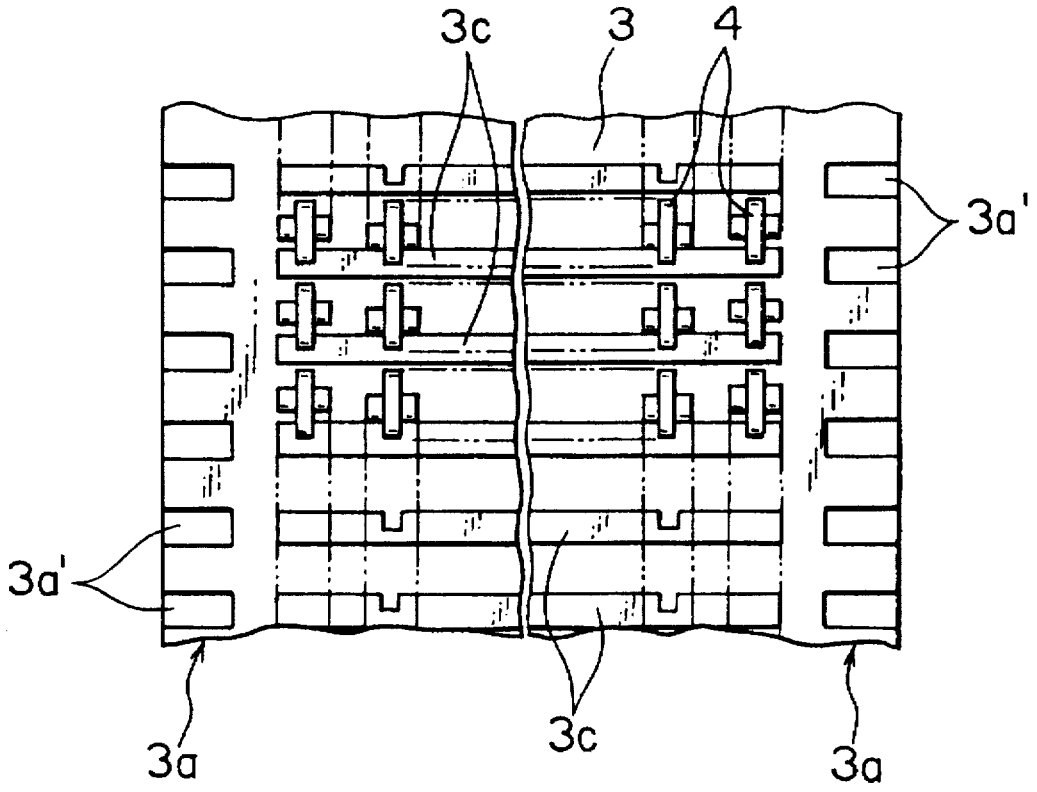
FIG. 5 is a fragmentary plan view showing another modification of the sheet fastener of the first embodiment.
Figure 6:
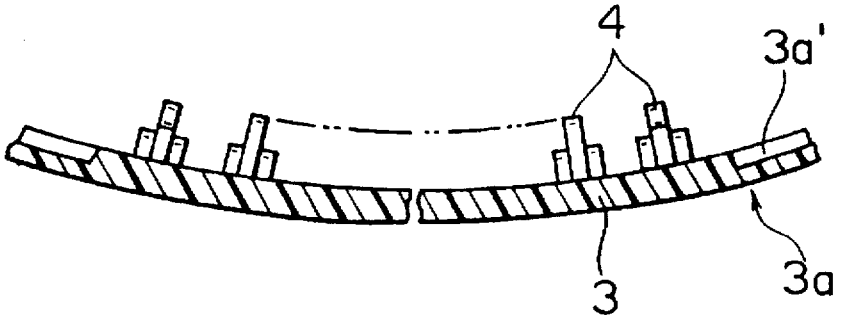
FIG. 6 is a fragmentary cross-sectional view showing still another modification of the sheet fastener of the first embodiment.

Further, in this embodiment, the plate-like substrate 3 has on one surface longitudinal grooves 3*b* between each adjacent pair of longitudinal rows of male engaging elements 4 as is apparent from FIGS. 1 through 3. The grooves 3*b* serve to give the substrate 3, which is originally rigid, an adequate degree of deformability and also to correct the incorrectly curved form created transversely of the substrate during molding. As long as it is possible to give an appropriate degree of deformability to the substrate 3, the plate-like substrate 3 may alternatively have on one surface transverse grooves 3*c* one between each pair of adjacent longitudinal rows of male engaging elements 4 as shown in FIG. 5. Further, the substrate 3 can be curved in molding in such a manner that its engaging-element-side surface becomes laterally concave with a predetermined curvature as shown in FIG. 6. At that time, the original curvature of the individual curved portion of the substrate 3 is set so as to cancel a possible lateral curvature, which will presumably occur after the ordinary molding.

Figure 7:
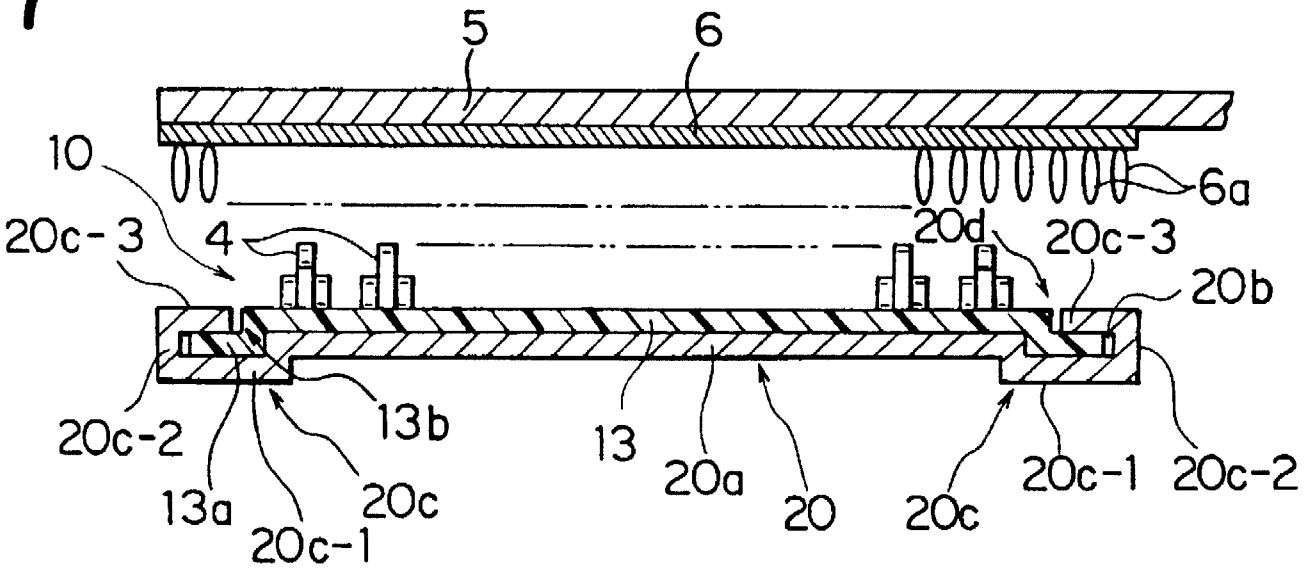
FIG. 7 is a cross-sectional view showing a sheet fastener, together with an attachment and a sheet-like article, according to a second embodiment of the invention.

FIG. 7 is a cross-sectional view showing the manner in which a sheet fastener 10 according to a second embodiment of the invention is attached to an attachment 20. In this embodiment, like the first embodiment, the sheet fastener 10 has a pair of opposite side margins 13*a* extending along the respective side edges of a plate-like substrate 13. But unlike the first embodiment, the side margins 13*a* of this embodiment are not in a common plane with respect to the plate-like substrate 13; part of the side margins 13*a* is glued or adhered to the lower surfaces of side edges of the plate-like substrate 13, while the remaining part of the side margins 13*a* is integrally molded with the substrate 13 so as to project outwardly from the side edges of the substrate 13. Accordingly, each side margin 13*a* extends sideways from the respective side edge of the plate-like substrate 13 via a stepped portion whose height is equal to the thickness of the substrate 13.

The attachment 20 has a shape complementary to the shape of the sheet fastener 10. Specifically, the attachment 20 has a plate-like attaching portion 20*a* for touching and supporting the substantially entire rear surface of the plate-like substrate 13, and a pair of opposite side fitting gutters 20*c* extending along the respective side edges of the plate-like attaching portion 20*a* for receiving the side margins 13*a* of the sheet fastener 10.

Each fitting gutter 20*c* has a bottom wall 20*c*-1 adapted to project horizontally from the lower surface of the respective side edge of the plate-like substrate 13, a vertical wall 20*c*-2 rising upwardly perpendicularly from the outer edge of the bottom wall 20*c*-1, and an upper wall 20*c*-3 projecting horizontally from the upper edge of the vertical wall 20*c*-2 toward the inner side. Thus the side edge of the plate-like substrate 13, the bottom wall 20*c*-1, the vertical wall 20*c*-2 and the upper wall 20*c*-3 jointly define a generally rectangular-cross-section fitting hollow 20*b*. Between the side edge of the plate-like substrate 13 and the upper wall 20*c*-3, there is defined a slit-like insertion gap 20*d* large enough to receive the side margin 13*a*.

The sheet fastener 10 of the second embodiment is to be firmly attached to the attachment 20 in the manner shown in FIG. 7. With the sheet fastener 10 attached to the attachment 20, since the upper surface of the plate-like substrate 13 and the upper surface of the upper wall 20*c*-3 of the fitting gutter 20*c* are disposed substantially in a common plane so that the entire stems of the hook-shape engaging elements 4 are exposed, it is possible to achieve both the same rate of engagement and the same degree of engaging strength as those of the ordinary molded surface fastener, thus requiring no necessity of reconstructing the conventional hook-shape engaging elements.

Figure 8:
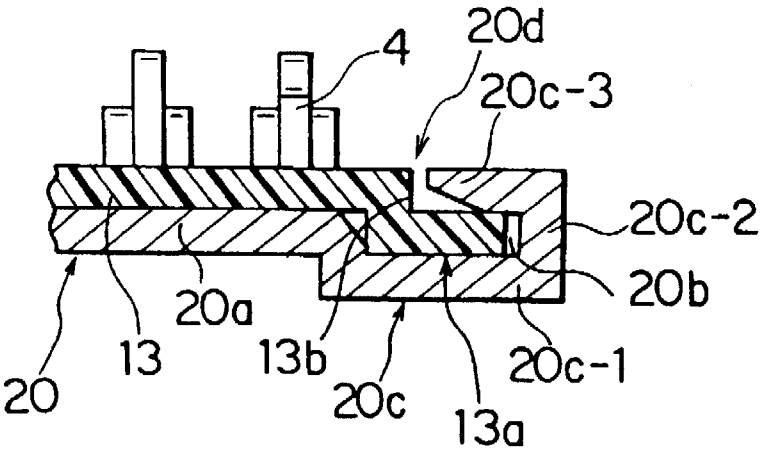
FIG. 8 is a detailed cross-sectional view showing a modification of the attachment to which the sheet fastener of the second embodiment is to be attached.

In attaching the sheet fastener 10 to the attachment 20, in order to facilitate inserting the complex-cross-section side margin 13*a* into the fitting gutter 20*c* of the attachment 20, it is preferable to taper the upper edge of the plate-like attaching portion 20*a* and/or the lower edge of the upper wall 20*c*-3 at the slit-like insertion gap 20*d* as shown in FIG. 8.

In each of the first and second embodiments, the sheet fastener 1, 10 is continuously molded by injection molding or extrusion molding using thermoplastic synthetic resin, such as polyamide resin, polyester resin or polypropylene resin. On the other hand, the attachment 2, 20 is molded in a shape having a desired cross section by the ordinary extrusion method using metal, such as aluminum alloy or stainless steel, or hard synthetic resin.

With the sheet fastener 1, 10 of the first or second embodiment having been attached to the attachment 2, 20, the surface fastener member 6, which has the female engaging surface of loop-shape engaging elements 6*a* and which is attached to the rear surface of the edge of a sheet-like article 5, such as a carpet, wall paper or a curtain, by suitable securing means such as sewing or adhering as shown in FIG. 7, is pressed against the male engaging surface of hook-shape engaging elements 4 of the sheet fastener 1, 10 to thereby bring the hook-shape engaging elements 4 into engagement with the loop-shape engaging elements 6*a*. The engaging elements 6 constituting the female engaging surface should by no means be limited to loop fibers, and alternatively, various female engaging elements having such a structure as to be engageable with the male engaging elements 4, i.e. various hooks, napped fibers of napping woven or knit cloth or non-woven cloth, may be used.

As is apparent from the foregoing description, according to the sheet fastener 1, 10 of this invention, partly since the sheet fastener 1, 10 can be firmly attached to the attachment 2, 20, and partly since the engaging elements 4 can project above the fitting cutters 2*c*, 20*c* of the attachment 2, 20 to an adequate extent without increasing the height of the stems of the engaging elements 4, it can be joined certainly and firmly with a surface fastener having companion female engaging elements attached to a sheet-like article.

What is claimed is:

1. A combination of a sheet fastener and an attachment for fastening a sheet-like article to the attachment, the attachment having along opposite side edges a pair of generally C-cross-section fitting gutters with confronting openings, and said fastener comprising:

a plate-like substrate having opposite side margins adapted to be fitted in the respective fitting gutters, said plate-like substrate having a thickness substantially equal to the width of each of the fitting gutters, said side margins having a number of discrete recesses longitudinally spaced at distances; and a multiplicity of surface-fastener male engaging elements projecting integrally from one surface of said plate-like substrate at its central region extending between said side margins.

2. A combination according to claim 1, wherein said plate-like substrate has continuous or discrete grooves in longitudinal or transverse rows between said male engaging elements.

3. A combination according to claim 1, wherein said plate-like substrate including said side margins is curved along its entire width with the engaging-element-side surface concave.

4. A combination according to claim 1, wherein said plate-like substrate has continuous grooves in at least one selected from the group consisting of longitudinal rows and transverse rows between said male engaging elements.

5. A combination according to claim 4, wherein each of said side margins has in part a wedge-shape cross section gradually decreasing in thickness toward the edge.

6. A combination according to claim 5, wherein said plate-like substrate including said side margins is curved along its entire width with the engaging-element-side surface concave.

7. A combination according to claim 4, wherein said plate-like substrate including said side margins is curved along its entire width with the engaging-element-side surface concave.

8. A combination according to claim 1, wherein said plate-like substrate has grooves in longitudinal rows between said male engaging elements.

9. A combination according to claim 8, wherein each of said side margins has in part a wedge-shape cross section gradually, decreasing in thickness toward the edge.

10. A combination according to claim 8, wherein said plate-like substrate including said side margins is curved along its entire width with the engaging-element-side surface concave.

11. A combination according to claim 1, wherein said plate-like substrate has grooves in transverse rows between said male engaging elements.

12. A combination according to claim 11, wherein each of said side margins has in part a wedge-shape cross section gradually decreasing in thickness toward the edge.

13. A combination according to claim 11, wherein said plate-like substrate including said side margins is curved along its entire width with the engaging-element-side surface concave.

14. A combination of a sheet fastener and an attachment for fastening a sheet-like article to the attachment, the attachment having along opposite side edges a pair of generally C-cross-section fitting gutters with confronting openings, and said fastener comprising:

a plate-like substrate having opposite side margins adapted to be fitted in the respective fitting gutters, said plate-like substrate having a thickness substantially equal to the width of each of the fitting gutters, said side margins having a number of discrete recesses longitudinally spaced at distances; and a multiplicity of surface-fastener male engaging elements projecting integrally from one surface of said plate-like substrate at its central region extending between said side margins;

wherein each of said side margins has in part a wedge-shape cross section gradually decreasing in thickness toward the edge.

15. A combination of a sheet fastener and an attachment for fastening a sheet-like article to the attachment, the attachment having along opposite side edges a pair of mutually formed fitting gutters each extending transversely from a lower portion of each of opposite side edges of a plate-like attaching portion via a stepped portion to define a fitting hollow having a generally rectangular cross section and to form a slit-like insertion gap along said stepped portion, and said fastener comprising:

(a) a plate-like substrate having opposite side, stepped margins to be substantially fitted into the respective fitting hollows of the fitting gutter of the attachment through the slit-like insertion gap; and (b) a multiplicity of surface-fastener male engaging elements projecting integrally from one surface of said plate-like substrate at its central region extending between said side margins.

16. A combination according to claim 15, wherein said fitting gutters include upper walls having tapered lower edges partly defining said slit-like insertion gap.

17. A combination according to claim 16, wherein said plate-like attaching portion has tapered upper edges adjacent said fitting gutters partly defining said slit-like insertion gap.

18. A combination according to claim 15, wherein said plate-like attaching portion has tapered upper edges adjacent said fitting gutters partly defining said slit-like insertion gap.

* * * * *